United States Patent [19]

Otoh et al.

[11] Patent Number: 5,046,324

[45] Date of Patent: Sep. 10, 1991

[54] DEFROSTING CONTROLLER FOR REFRIGERATION SYSTEMS

[75] Inventors: Tadao Otoh, Ohta; Yoshihisa Ishida; Satoshi Ohya, both of Gunma; Masaki Ishiguro, Ohta, all of Japan

[73] Assignee: Sanyo Electric Co., Ltd., Osaka, Japan

[21] Appl. No.: 541,886

[22] Filed: Jun. 20, 1990

[51] Int. Cl.[5] ..... F25D 21/06

[52] U.S. Cl. ..... 62/155; 62/156

[58] Field of Search ..... 62/154, 155, 156, 234, 62/140

[56] References Cited

U.S. PATENT DOCUMENTS 4,156,350 5/1979 Elliott et al. ..... 62/155
4,173,871 11/1979 Brooks ..... 62/155
4,297,852 11/1981 Brooks ..... 62/155
4,528,821 7/1985 Tershak et al. ..... 62/156
4,938,027 7/1990 Midlang ..... 62/156

*Primary Examiner*—Harry B. Tanner
*Attorney, Agent, or Firm*—Stanger, Michaelson, Spivak & Wallace

[57] ABSTRACT

A defrosting controller for use with a refrigeration system determines calculating a frost melting period from the measurements of the evaporator temperature during defrosting by means of an evaporator temperature sensor, establishes a refrigerating operation rate which is the ratio of the period of the frost melting process to the (total) open period of an electronic motor-driven valve during the refrigeration, and then decides whether the next defrosting operation is to be skipped or not.

2 Claims, 6 Drawing Sheets

DEFROSTING CONTROLLER FOR REFRIGERATION SYSTEMS

FIELD OF THE INVENTION

The invention relates to a defrosting controller for controlling defrosting refrigeration systems employed in air conditioning apparatuses, refrigerators, and refrigeration show cases, by the use of a refrigerant flow rate controller.

BACKGROUND OF THE INVENTION

A refrigerant flow rate controller utilizing a thermoelectric expansion valve, which is a type of electronic motor-driven valve is disclosed in Japanese Patent Publication (sho) 58-47628 (IPC, F25B41/06) and published in "reitoh" (refrigeration) PP. 60–64, Vol. 56, No. 641 (March, Showa 56). This refrigerant flow rate controller has a first temperature sensor positioned at or near the refrigerant inlet of the evaporator and a second temperature sensor at the refrigerant outlet of the evaporator. The electric signals from the sensors are compared with control of the refrigerant flow rate based on the difference between them so as to maintain the opening of the expansion valve and consequently to keep the superheating in the evaporator approximately constant.

In addition to the above, i.e. the electronic motor-driven valve control for the superheating, temperature control of the space to be cooled (hereinafter referred to refrigeration space) has been introduced in U.S. Pat. No. 4,745,767. This refrigerant flow rate controller is described below with reference to FIGS. 1–3.

FIG. 1 shows a schematic construction of the overall refrigerating system for use for example with a low-temperature show case installed in a supermarket. FIG. 2 is a block diagram of the control circuit of the refrigerant flow rate controller. FIG. 3 illustrates the variation in temperature of the refrigeration chamber under control of the controller, as a function of the operation of the electronic motor-driven valve.

As FIG. 1 shows, a compressor 1, a condenser 2, an electronic motor-driven valve 3, and an evaporator 4 are connected by tubes to form a closed loop of refrigerant circuit 5. The electronic motor-driven valve 3 is a pulse-driven electronic expansion valve. A fan 7 installed at a lower position of the cold air passage 6 of a low-temperature show case I takes in air from an air intake port 8*a*, which air is cooled by the evaporator 4 and discharged from an air discharge port 8*b*, to form an air curtain A to cut the influence of ambient air on the refrigeration space 9.

The electronic motor-driven valve 3 is controlled by a control signal a received from a controller 10 e.g. a micro-computer, such that opening of the value 3 permits regulated flow of decompressed refrigerant from the condenser 2 to the evaporator 4. Detector signals $b_1$, $b_2$, $b_3$, and $b_4$ control the electronic motor-driven valve 3. Detection signals $b_1$, and $b_2$ are obtained by forming electric signals from the temperatures detected by the inlet evaporator temperature sensor 11 at or near the evaporator 4 inlet and the temperature detected by the evaporator outlet temperature sensor 12, respectively. The detection signals $b_3$ and $b_4$ are obtained by forming electric signals from the temperature detected by means of the returned air temperature sensor 13 measuring the temperature of the air returning to the intake port 8*a* and a discharge air temperature sensor 14 measuring the temperature of the air discharge, respectively. When input in the controller 10, these signals $b_1$, $b_2$, $b_3$, and $b_4$ are processed therein and transmitted in the form of control signal a to electronic motor-driven valve 3. More particularly, the detection signals $b_1$, and $b_2$ from the evaporator temperature sensor 11 and evaporator outlet temperature sensor 12 concerns control of the superheating, while the detection signals $b_3$ and $b_4$ from the returned air temperature sensor 13 and discharging air temperature sensor 14 concerns temperature control of the air in the refrigeration space.

Specific control operations carried out with such detection signals $b_1$, $b_2$, $b_3$, and $b_4$ are as follows.

A refrigerant flow rate control unit S having structure shown in FIG. 2 includes a first comparator 15 for comparing a feed back signal with a reference value representative of required superheating, an inner algorithm section 16 for regulating internal relationships, a valve driver 17 for driving the valve, an evaporator temperature calculator 18 for calculating the temperature of the evaporator 4, a refrigeration space temperature calculator 19 for caluclating the measured temperature of the refrigeration space 9, a second comparator 20 for comparing the temperature of the refrigeration space 9 with its reference temperature, and a valve full-close signal generator 21 for fully closing the valve.

In the evaporator temperature calculator 18, the detection signal $b_2$ from the evaporator outlet temperature sensor 12 and the detection signal $b_1$ from the evaporator temperature sensor 11 are processed to give measured superheating (SH) which is in turn compared with the preset superheating (SHS) in the first comparator 15. The deviation of the former from the latter is input in the form of a deviation signal DV into the inner algorithm section 16 and corrected therein. The valve driver 17 receives this corrected signal as a regulating signal (HSS) and continually outputs valve opening regulating signal (BKC) to the electronic motor-driven valve 3 based on the deviation. The valve opening regulating signal (BKC) applied to the valve 3, which are pulse mode signals free of external perturbations (DT), result in appropriate mechanical regulation of its opening i.e. the cross sectional area of the valve, to thereby regulate of the refrigerant flow rate (GA) such that the superheating will remain within the preset value, say 5° C. Such controlled regulation of the electronic motor-driven valve 3 is performed in steps during the pull-down operation period $t_a$ subsequent to defrosting operation and period $t_b$ of refrigeration in the thermocycle mode (which will be described in detail later), as shown in FIG. 3. Consequently, the measured temperature $T_M$ for the refrigeration space may reach the preset temperature $T_S$. It should be born in mind that in each of the refrigerating periods $t_a$ and $t_b$, opening of the electronic motor-driven valve 3 is regulated in steps. That is, although the open/close condition of the valve 3 is indicated as by ON and OFF, the actual opening changes in steps in accordance with the deviation of the measured superheating (SH) from the preset superheating (SHS).

On the other hand, the refrigeration space temperature calculator 19 calculates the temperature $T_M$ of the refrigeration space 9 from the detected signal $b_4$ obtained from the discharging air temperature sensor 14 and the detection signal $b_3$ obtained from the returned air temperature sensor 13. The measured refrigeration space temperature $T_M$ is compared in the second comparator 20 with the preset temperature $T_S$. When $T_M \leqq T_S$, a valve full-close signal (BP) is emitted from the valve full-close signal generator 21 to the valve driver 17 to fully close the electronic motor-driven valve 3 over $t_d$ as shown in FIG. 3 so as to prevent excessive cooling of the refrigeration space 9. This temperature control mode is called thermocycle mode.

With such refrigerant flow rate control, i.e. using a electronic motor-driven valve, refrigeration power of the evaporator 4 drops during the course of refrigeration due to the deposition of frost generated by the condensation of the water vapor in the damped air passed over the evaporator 4. Therefore, it is necessary to remove such frost, so that defrosting operations are periodically carried out. Instructions for such defrosting operations are provided from the controller 10 in the form of periodic defrosting signals (C) from means such as a timer. In response to a defrosting signal the electronic motor-driven valve 3 is fully closed to stop circulation of the refrigerant during defrosting. In FIG. 3 a defrosting signal C is output at time $\tau_1$ at which defrosting is started. That is the electronic motor-driven valve 3 is fully closed to stop refrigeration, and a defrosting heater is turned on or a hot gas is supplied to the evaporator. Near the end of the defrosting cycle a sharp rise in temperature may be observed in the neighborhood of the evaporator 4, which is detected by some means such as a defrosting temperature sensor and the defrosting is terminated at $\tau_a$.

At this point refrigeration is resumed, which lasts over the period $T_A$. Such defrosting will repeat in such a way that the next defrosting starts at time $\tau_5$ which is T after $\tau_1$ and lasts period $T_B$. The temperature in the refrigeration space rises during the defrosting.

A disadvantage encountered in this periodic defrosting is as follows. Low-temperature show cases in e.g. a supermarket are usually covered with so-called night caps over the refrigeration space storing goods when the shop is closed. Then the show case is insulated from the ambient air. Since the amount of frost deposited on an evaporator increases with the running period of the use of the show case and the frequency of the infiltration of ambient air into the show case, the amount of frost during such closed hours is extremely little. Hence, under such circumstances defrosting is not necessarily needed. Nevertheless the show case is forced to undergo defrosting operations, not only wastefully consuming electricity or hot gas, but also resulting in undesirable temperature rise in the refrigeration system and creating a disadvantageous influence on the quality of goods stored therein. Also, there may be some shopping hours when few customers open the show case and periodic defrosting is not needed. Periodic defrosting in such cases merely results in undesirable effects on the goods.

BRIEF SUMMARY OF THE INVENTION

The present invention is directed to a new defrosting controller that is capable of estimating the amount of frost deposited on the evaporator and, based on the estimation, determining necessity of a defrosting operation.

The defrosting controller for refrigeration systems according to the invention comprises: a compressor; a condenser; an evaporator; an electronic motor-driven valve for regulating the flow rate of the refrigerant through the evaporator; an evaporator temperature sensor for detecting the temperature of the evaporator; and a controller for providing control signals for controlling the electronic motor-driven valve based on the measurement with the evaporator temperature sensor and providing defrosting signals as needed, wherein the controller calculates a frost melting period (defined below) from the measurements of the evaporator temperature during defrosting by means of the evaporator temperature sensor and a refrigerating operation rate which is the ratio of the (total) period of the electronic motor-driven valve open during the refrigeration (called OPEN VALVE PERIOD) to the refrigeration period, and decides based on these results whether the next defrosting operation be skipped or not.

Until the frost vanishes from the evaporator the temperature of the evaporator remains at 0° C. even during defrosting due to the latent heat of the frost on the evaporator. Defrosting during such period is defined as FROST MELTING PROCESS. The temperature of the evaporator promptly rises above 0° C. as the frost disappears. By detecting such temperature rise, the period of the frost melting process may be obtained. Since the frost melting period is a measure of the amount of the frost deposited in the last refrigeration cycle, it is possible to estimate the amount of frost presently deposited under the same refrigerating condition, from which the necessity of the next defrosting may be decided. However, it may be that defrosting condition may have been changed due to, for example, a change in refrigeration load. In a case where the amount of frost has actually decreased an execution of the same defrosting as the preceding one based on the estimation will again waste energy and be useless.

Thus, the invention takes account of the present refrigeration condition into the frost estimation. Namely, the ratio, called refrigeration operation rate, of the total period of time when the electronic motor-driven valve is open for refrigeration to the refrigeration cycle period is calculated for this purpose. From this refrigeration operation rate the amount of frost to be deposited at the end of the present refrigeration cycle is estimated to make a decision on whether or not the next frost melting is needed. If the estimated amount of frost is less than a predetermined value, the next defrosting operation is skipped, thereby not only saving energy that would be otherwise used up in the heater but also preventing deterioration of the goods stored in the refrigeration space.

DETAILED DESCRIPTION OF THE PREFERRED EMBODIMENT

Figure 1:
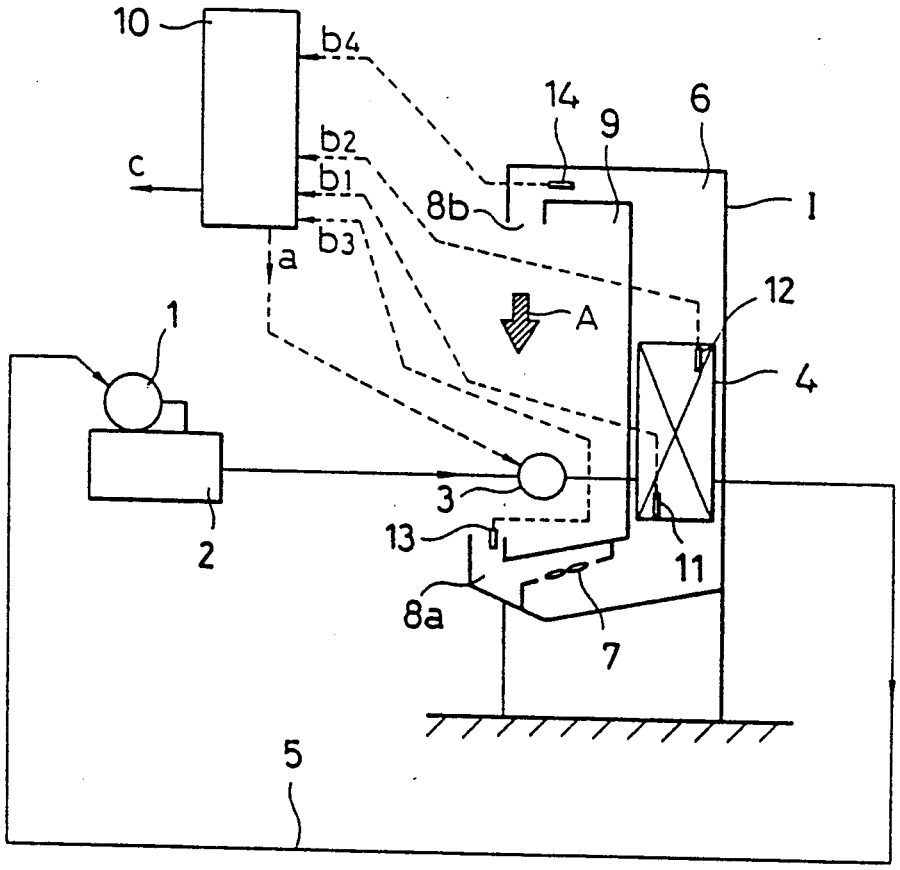
FIG. 1 (PRIOR ART)
FIG. 1 illustrates the concept of a prior refrigeration system.
Figure 2:
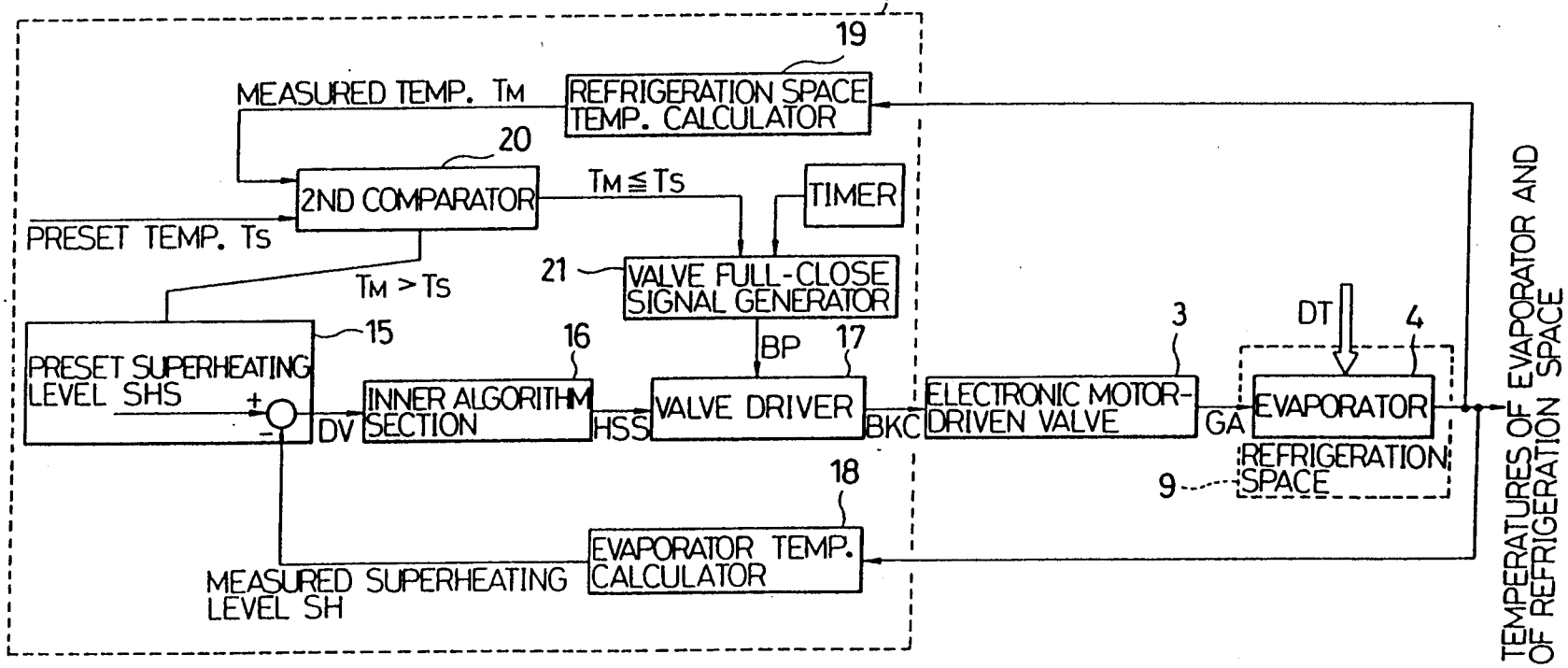
FIG. 2 (PRIOR ART)
FIG. 2 illustrates an example of a prior art refrigerant flow rate controller.
Figure 3:
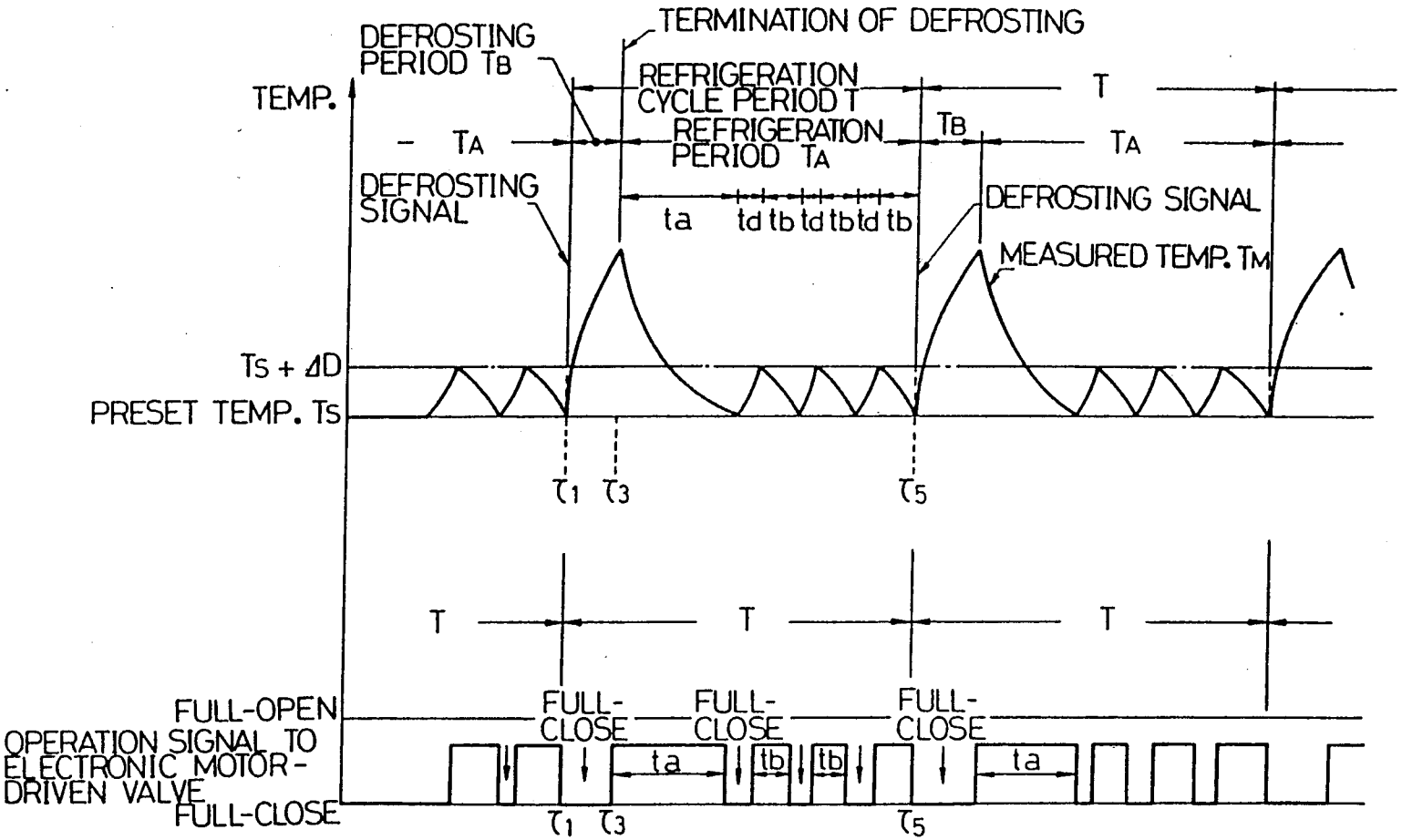
FIG. 3 (PRIOR ART)
FIG. 3 illustrates the relationship between the condition of the electronic motor-driven valve and the temperature in the refrigeration space under the control of the refrigeration flow rate controller.
Figure 4:
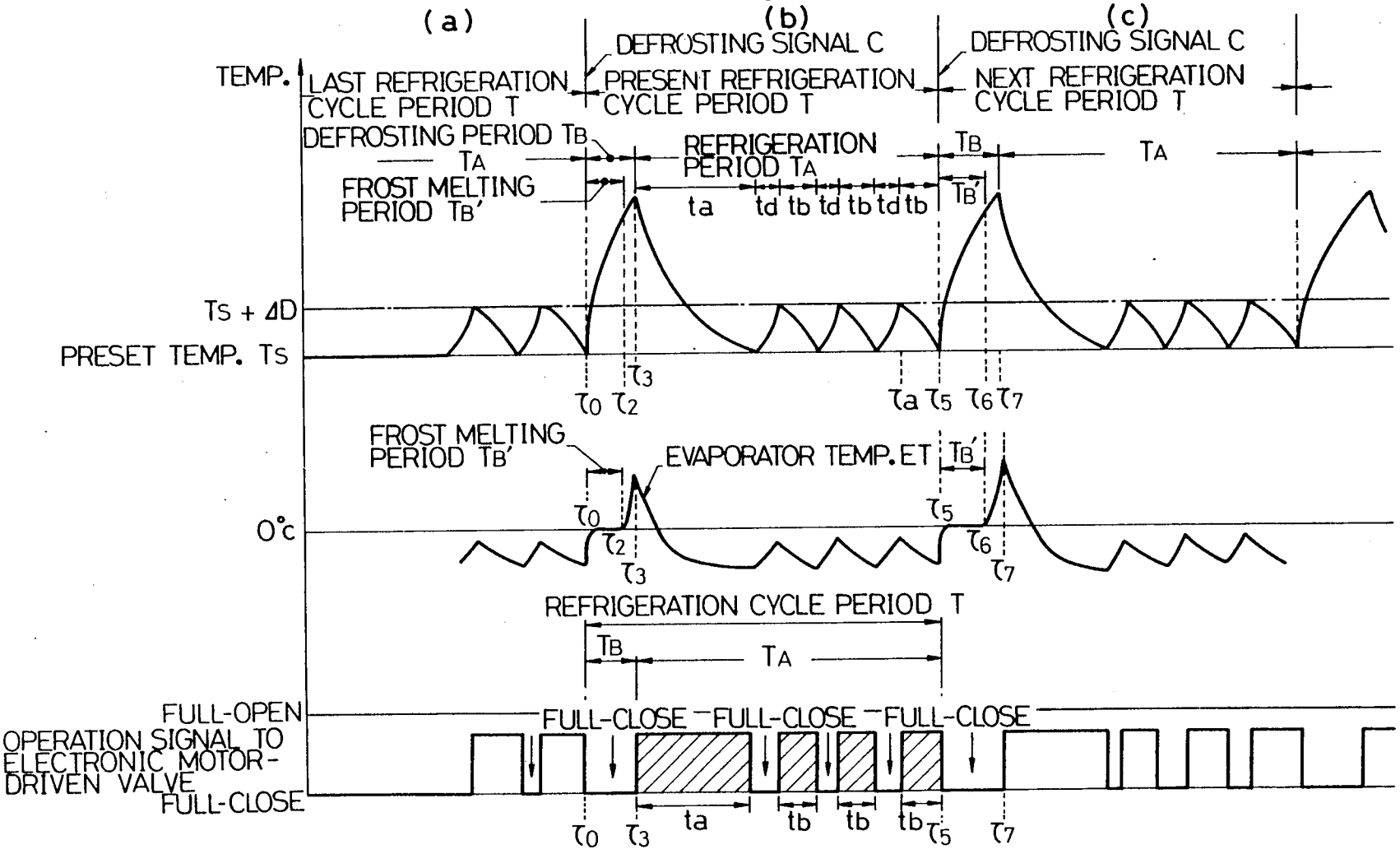
FIG. 4 illustrates the relation of the temperature of the refrigeration space to the valve conditions and to the temperature of the evaporator of the invention under the control of the flow rate controller.

In FIG. 4 the defrosting signals C are generated periodically with a period of T, so that if a defrosting signal $C_0$ is provided at time $t_0$ the next defrosting signal C will be given at time $\tau_5$. This period T is also a period of one refrigeration cycle which consists of defrosting a period $T_B$ and a refrigeration operation period $T_A$. The figure shows three refrigeration cycles, which are (b) present refrigeration cycle, (c) next refrigeration cycle, and (a) the last cycle. We can say that the length of the defrosting period $T_B$ of the present refrigeration cycle (b) indirectly represents the amount of the frost deposited in the receding period (a). Unless the refrigeration conditions have been changed to (due to, for example, change of operation modes and/or refrigeration load), it is expected to have the same amount of frost deposited at the end of the present refrigeration cycle (b). Hence, it is possible to decide from this defrosting period $T_B$ stored in a memory whether the next defrosting is needed or not. The defrosting period $T_B$ may be easily obtained by a procedure described below. The evaporator maintains 0° C. until the frost thereon is completely evaporated by a defrosting means such as a heater or hot gas. However, when the frost disappears the heat provided from the defrosting means serves quickly to raise the temperature ET of the evaporator, indicating the completion of the defrosting. This rise in temperature may be detected by an evaporator temperature sensor 11, which serves to control the superheating (in the evaporator). The period $T_B$ may be determined as time interval between the time $\tau_2$ at which this detection is signaled and the time $\tau_0$ at which the signal C was generated to start the defrosting. The period $T_B$ is the time required to melt all the frost, and this process is called frost melting process. However, in actuality defrosting is terminated at $\tau_3$ a little later than $\tau_2$ in order to make the defrosted water evaporated completely from the surface of the evaporator.

The decision on whether or not the next defrosting is needed based on the frost melting period $T_B$ is made as follows. The decision may be made based on the frost melting period $T_B$ indicating the amount of the frost in the last refrigeration cycle (a), and assuming the same refrigeration in the present refrigeration cycle (b) as in the last refrigeration cycle (a). However, in cases where a refrigeration system such as a low-temperature show case I is refrigerated during night when the shop is closed, it is subjected to a low refrigerating load with little external thermal disturbance, and the amount of the frost is rather small. Hence the refrigeration operation rate must be low for the low-temperature show case, and it may not be appropriate to furnish regular defrosting.

In such cases the refrigeration operation rate $\epsilon$ of the present regrigeration may be used for a more accurate decision. The refrigeration operation rate $\epsilon$ is the ratio of the total time $T_N$ that the electronic motor-driven valve 3 was open for refrigeration, to the refrigeration period $T_A$, as defined by $$\text{refrigeration operation rate } \epsilon = \frac{t_a + t_b + \cdots t_b}{T_A} = \frac{T_N}{T_A}$$

When this refrigeration rate $\epsilon$ is smaller than the reference operation rate $\epsilon_0$, then the next defrosting is skipped.

The decision based on the comparison of the refrigerating rate $\epsilon$ with the reference operation rate $\epsilon_0$ permits elimination of unnecessary defrosting, yielding a high refrigeration efficiency.

Figure 5:
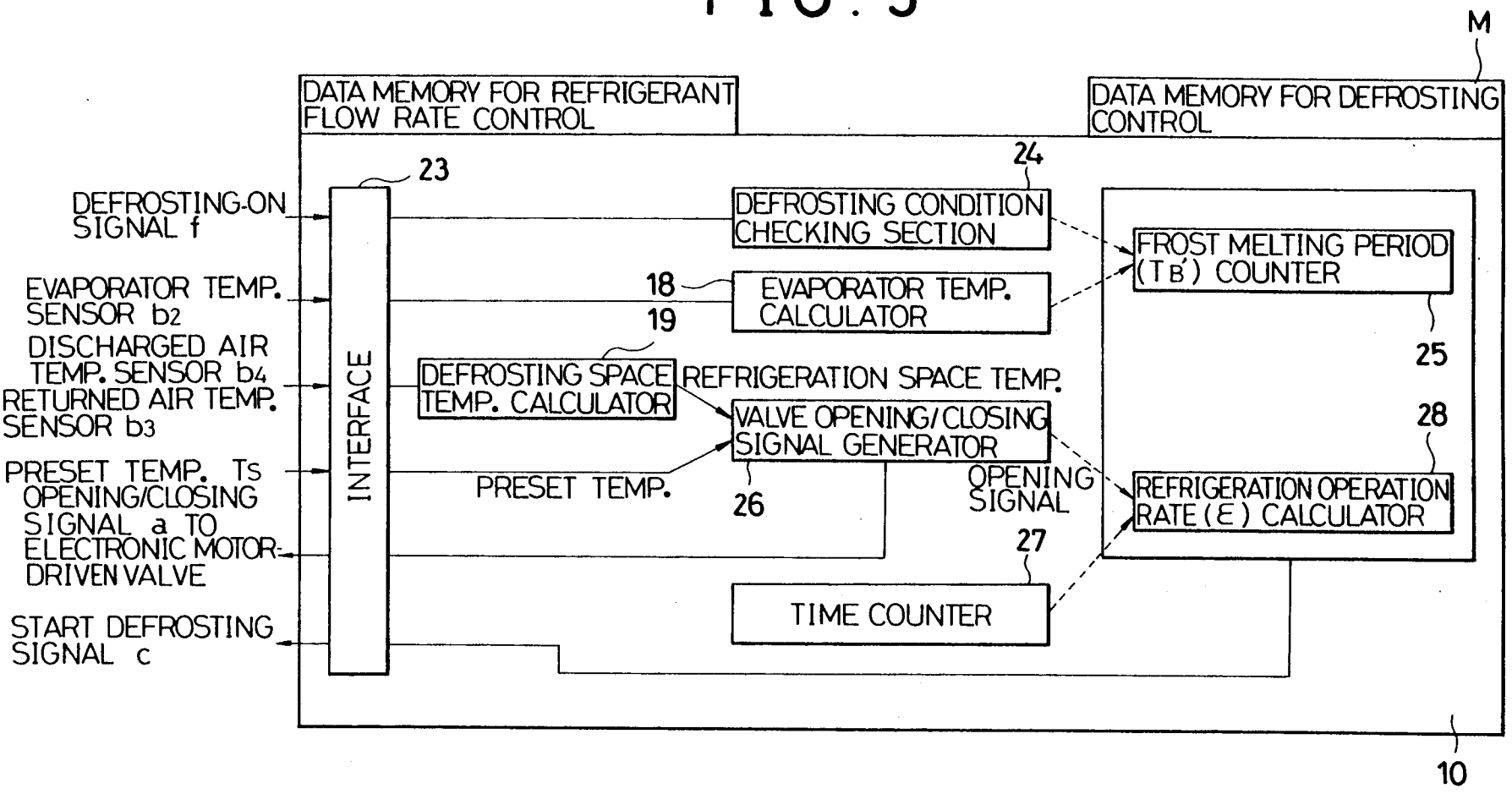
FIG. 5 is a block diagram of a control circuit for the defrosting controller of the invention.

FIG. 5 is a block diagram carried out in the controller 10 for making the decision on the next defrosting described above, in which interface 23 receives defrosting-ON signals f representative of continuing refrigeration, detection signal $b_2$ from the evaoprator temperature sensor 11, detection signals $b_4$ and $b_3$ from the discharged air temperature sensor 14 and returned air temperature sensor 13, and preset temperature value $T_S$ from a refrigeration space temperature presetting means (not shown). The interface 23 in turn outputs valve opening/closing signals a to the electronic motor-driven valve 3 to open/close the valve (in steps), and start defrosting signal c to start defrosting. The defrosting condition checking section 24 confirms from the defrosting-ON signal f that defrosting is proceeding. The evaporator temperature calculator 18 calculates from the detection signal $b_2$ the temperature of the evaporator, which temperature will be monitored on in the presence of the defrosting-ON signal f. The evaporator temperature sensor 11 mounted on the evaporator 4 will find the temperature of the evaporator at 0° C. until the frost thereon disappears, when the temperature rises above 0° C. The frost melting period counter 25 calculates the period $T_B'$ during which the temperature of the evaporator remains at 0° C. The period $T_B'$ thus calculated is stored once in a memory M. The period $T_B'$ is recalled at an appropriate time $\tau_a$ of a refrigeration period $T_A$ for use in making the decision on the next defrosting, in a manner as described later in connection with FIG. 6. On the other hand the temperature of the refrigeration space (which is referred to as refrigeration space temperature) is obtained in the refrigeration space temperature calculator 19 from the detection signals $b_3$ and $b_4$, and is compared with the preset temperature. The valve opening/closing signal generator 26 is adapted to operate to close the electronic motor driven valve 3 under the condition that the refrigeration space temperature $\leqq$ preset temperature. The controller 10 includes an internal time counter 27, which counts a fixed time interval T between the successive generation of defrosting signals C. The internal time counter 27 generates signals called "start defrosting signals" periodically.

Thus, the refrigeration cycle operation rate $\epsilon$ is calculated in the refrigeration operation rate calculator 28 according to the following equation $$\frac{\text{valve open period}}{\text{refrigeration period}} = \frac{T_N}{T_A} = \epsilon$$

where the refrigeration period $T_A$ is the period for refrigeration.

Figure 6:
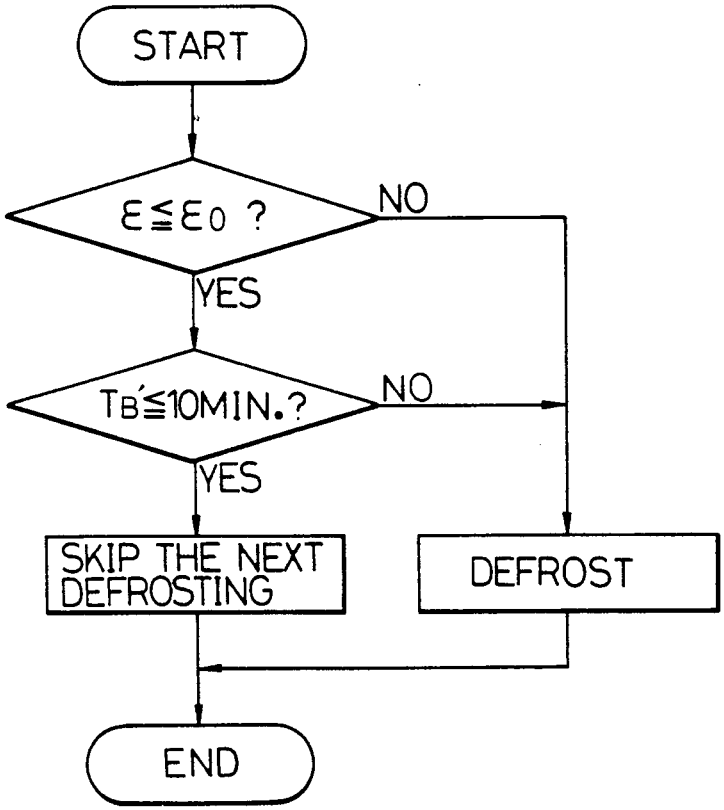
FIG. 6 is a flow chart for the process, carried out in the control circuit, of deciding whether the next defrosting operation is needed.

From these frost melting period $T_B'$ and operation rate $\epsilon$ of the refrigeration cycle, the decision for a next defrosting signal is made. In particular, through calculations and decisions as shown in FIG. 6, generation of defrosting signal C is omitted to skip the next refrigeration when the operation rate $\epsilon$ is smaller than the reference operation rate $\epsilon_0$ and the last frost melting period $T_B'$ is less than 10 minutes.

It would be apparent that those signals f, $b_2$, $b_3$, $b_4$ and preset temperature signal $T_S$ entering the interface 23 are also used as actuating signals for actuating the refrigerant flow rate controller S to control superheating and the refrigeration space temperature.

Based on the operation rate $\epsilon$ and the last frost melting period $T_B'$ thus calculated, an estimation is made of the amount of frost deposited at the end of the present refrigeration cycle T, from which a decision is made if the next defrosting operation is to be skipped or not.

The procedure described above for avoiding unnecessary defrosting will not only save hot gas or other thermal energy for heating the evaporator but also prevent the deterioration of the goods due to undesirable defrosting, which is a great advantage for long term economy and preservation of fresh goods.

We claim:

1. A defrosting controller for refrigeration systems, comprising:

a compressor;

a condenser;

an evaporator;

an electronic motor-driven valve for regulating the flow rate of the refrigerant to be supplied to the evaporator;

an evaporator temeperature sensor provided for detecting the temperature of the evaporator; and a controller for providing control signals for controlling the electronic motor-driven valve based on the measurement with the evaporator temperature sensor and providing defrosting signals as needed, wherein the controller has a decision means for deciding whether the next defrosting operation be skipped or not, based on the refrigerating operation rate determined by the frost melting period measured with the evaporator temperature sensor during defrosting and by the ratio of the (total) period of the electronic motor-driven valve open in a refrigeration period to the refrigeration period.

2. A defrosting controller for refrigeration systems, as recited in claim 1, wherein said decision means has means for comparing said refrigeration operation rate and said frost melting period with respective reference values and for skipping generating the defrosting signal for the next defrosting operation if they are equal to or less than the reference values.

* * * * *